US006615919B2

(12) United States Patent
Osgood et al.

(10) Patent No.: US 6,615,919 B2
(45) Date of Patent: Sep. 9, 2003

(54) WELL PIPE EXTRACTION APPARATUS

(75) Inventors: James E. Osgood, Camarillo, CA (US); William R. Major, Summerland, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/006,776

(22) Filed: Dec. 7, 2001

(65) Prior Publication Data

US 2003/0106691 A1 Jun. 12, 2003

(51) Int. Cl.[7] ..... E21B 31/00
(52) U.S. Cl. ..... 166/301; 166/98; 294/86.1
(58) Field of Search ..... 166/98, 99, 301; 294/86.1, 86.14, 86.4, 96, 86.42; 254/133 R; 405/174, 184

(56) References Cited

U.S. PATENT DOCUMENTS 1,723,893 A * 8/1929 Shultz ..... 294/86.1
1,830,207 A * 11/1931 Mueller ..... 166/55.7
2,769,655 A * 11/1956 Holmes ..... 294/86.25
2,965,175 A * 12/1960 Ransom ..... 166/98
4,580,826 A * 4/1986 Carver et al. ..... 294/86.17
4,643,465 A * 2/1987 Green et al. ..... 285/236
4,796,347 A * 1/1989 Aguillen et al. ..... 29/280
4,969,677 A * 11/1990 Melegari ..... 294/86.42
4,997,225 A * 3/1991 Denis ..... 294/86.25
5,029,924 A 7/1991 Stuckey ..... 294/86
5,094,496 A * 3/1992 King, Sr. ..... 294/96
5,597,192 A * 1/1997 Smith ..... 294/96
5,653,554 A 8/1997 Preston et al. ..... 405/154
5,988,719 A * 11/1999 Lavender ..... 294/96
5,997,597 A 12/1999 Hagan ..... 51/309

* cited by examiner

*Primary Examiner*—David Bagnell
*Assistant Examiner*—Daniel P Stephenson
(74) *Attorney, Agent, or Firm*—David S. Kalmbaugh

(57) ABSTRACT

A well pipe extraction apparatus for removing a groundwater monitoring well consisting of PVC pipe from the ground. The well pipe extraction apparatus includes a wire rope, a soft eye formed at an upper end of the wire rope and knurled brass rod attached to the opposite end of the wire rope. The knurled brass rod is lowered to the bottom end of the well casing. An operator pours sand particles down the well casing. The sand particles wedge in-between groves within the brass rod and the interior surface of the well casing locking brass rod to the well casing which allows the operator to extract the PVC pipe from the ground.

15 Claims, 3 Drawing Sheets

WELL PIPE EXTRACTION APPARATUS

BACKGROUND OF THE INVENTION

1. Field of the Invention

The present invention relates generally to a pipe extraction apparatus, and more particularly pertains to a new and improved well pipe extraction apparatus adapted for the removal of relatively brittle PVC pipe from the ground without breaking pipe.

2. Description of the Prior Art

Thousands of groundwater monitoring wells have been installed at environmental restoration sites in the United States and other countries throughout the world. A substantial amount of these groundwater monitoring wells are intended to monitor a temporary contaminated site condition, and upon completion of the remediation effort, will need to be removed. Monitoring wells no longer in use and that are not fully extracted from the ground can act as a conduit for contaminants to flow to groundwater. This, in turn, raises serious public health issues. Furthermore, it is difficult for regulators to monitor well removal and insure that all components of a well have in fact been removed. With decreasing government and commercial environmental funds available, many restoration programs are now confronted with exorbitantly high costs to remove their groundwater monitoring wells and currently have little or no cost-effective options to meet regulatory removal requirements for well removal.

Presently, removal of monitoring wells formed of relatively brittle PVC pipe is delicate operation as undue torquing of such piping results in weakening and potential fracture of such pipe resulting in enhanced cost and time in removal. When an attempt is made to secure a PVC pipe for extraction from the ground, frictional engagement of an interior surface of such pipe frequently results in fracture due to the nature of PVC pipe.

Other existing methods to remove PVC pipe involve either clamping to an exposed above ground portion of the well and pulling the well out of the ground or over-drilling the well before removal of the pipe. Clamping and pulling on the above ground portion of the well will consistently separate the well components (especially in the case of PVC pipe wells) leaving unretrievable portions of the well in the ground.

Over-drilling essentially makes a larger hole around the existing well so the PVC pipe which forms the well can be easily removed. However, well components can still separate by this method making retrieval of the remaining components very difficult, especially in deep wells. Over-drilling is also very costly and time consuming, requiring large drill rigs and generating substantial amounts of contaminated soil waste in the over-drilling process. Additionally, over-drilling adversely impacts a site by making significantly larger holes around the wells.

As such it may be appreciated that there continues to be a need for a new and improved monitoring well pipe extractor which addresses the problems of ease of use and effectiveness to engage and permit extraction of a well pipe from an in-ground placement.

SUMMARY OF THE INVENTION

The present invention overcomes some of the difficulties of the past including those mentioned above in that it comprises a relatively simple and inexpensive yet highly reliable well pipe extraction apparatus for the removal of brittle PVC pipe from the ground without breaking pipe.

A well pipe extraction apparatus for removing a groundwater monitoring well consisting of PVC pipe from the ground. The well pipe extraction apparatus includes a wire rope, a soft eye formed at an upper end of the wire rope and knurled brass rod attached to the opposite end of the wire rope. An operator lowers the knurled brass rod to the bottom end of the well casing. The operator then pours sand particles down the well casing. The sand particles wedge in-between groves within the brass rod and the interior surface of the well casing locking brass rod to the well casing creating a force sufficient to allow the operator to extract the PVC pipe from the ground.

DETAILED DESCRIPTION OF THE PREFERRED EMBODIMENT

Figure 1:
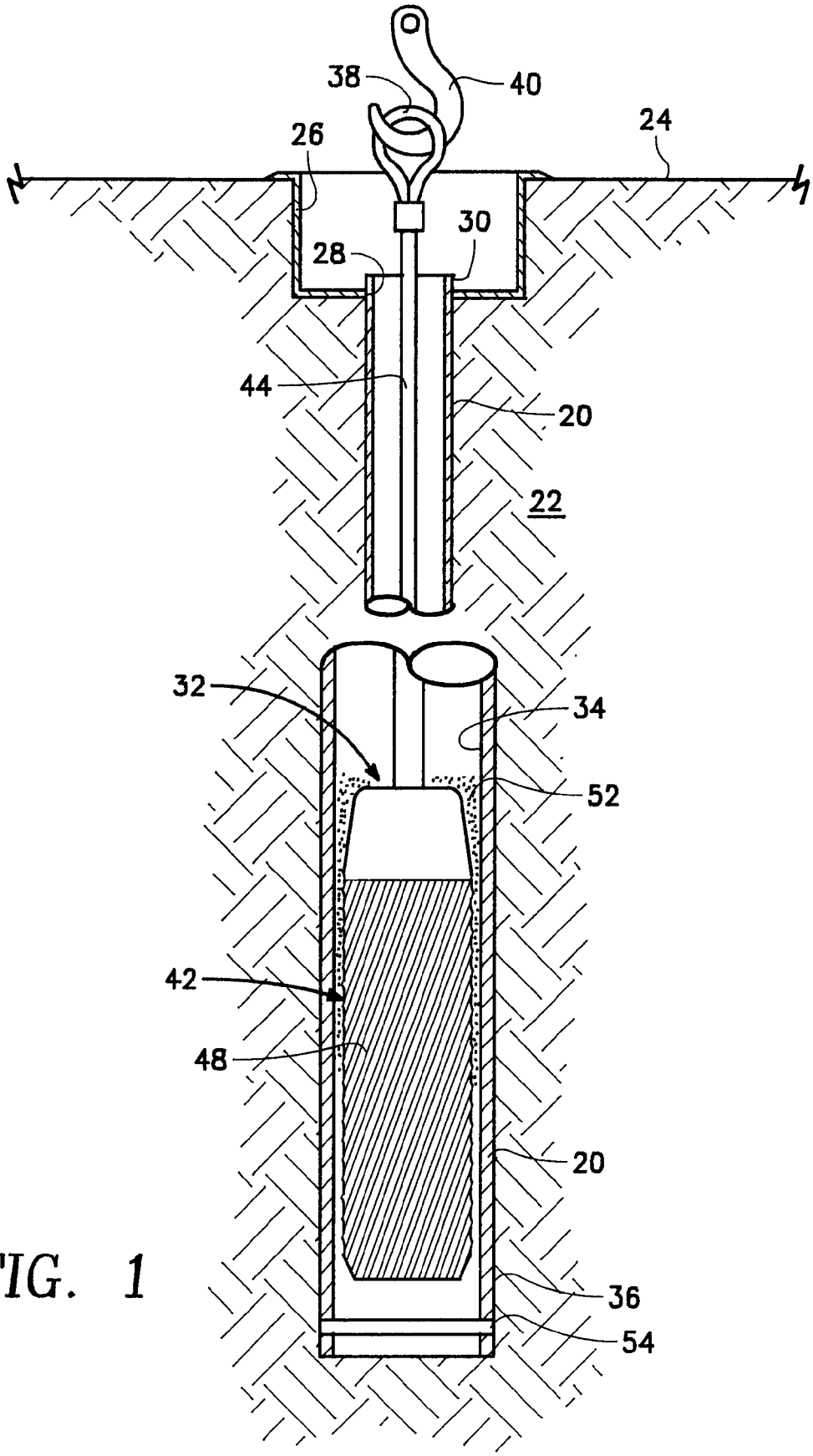
FIG. 1 illustrates the well pipe extraction apparatus being deployed to remove a relatively brittle PVC pipe from the ground without breaking PVC pipe.

Referring to FIG. 1, there is shown a groundwater monitor well casing 20 which is inserted into the ground 22 and which must be removed from the ground 22. At ground level 24, there is a street box 26 which has an opening 28. Well casing 20 is inserted into the ground 22 through opening 28 of street box 26 with the upper end 30 of well casing 20 being positioned within street box 26. Groundwater monitor well casing 20 is generally fabricated from PVC pipe which is fragile and subject to breakage.

A well pipe extraction apparatus 32 locks onto the interior surface 34 at bottom end 36 of groundwater monitor well casing 20 which allows the user to remove the entire well casing 20 by direct upward pull. The well pipe extraction apparatus 32 has a soft eye 38 positioned to its upper end which protrudes one foot above ground level 24. Soft eye 38 is attached to the hook 40 of a hoist machine; which may be a crane, a winch or other lifting equipment, allowing the hoist equipment when activated to remove the well casing 20 from the ground 22.

Figure 2:
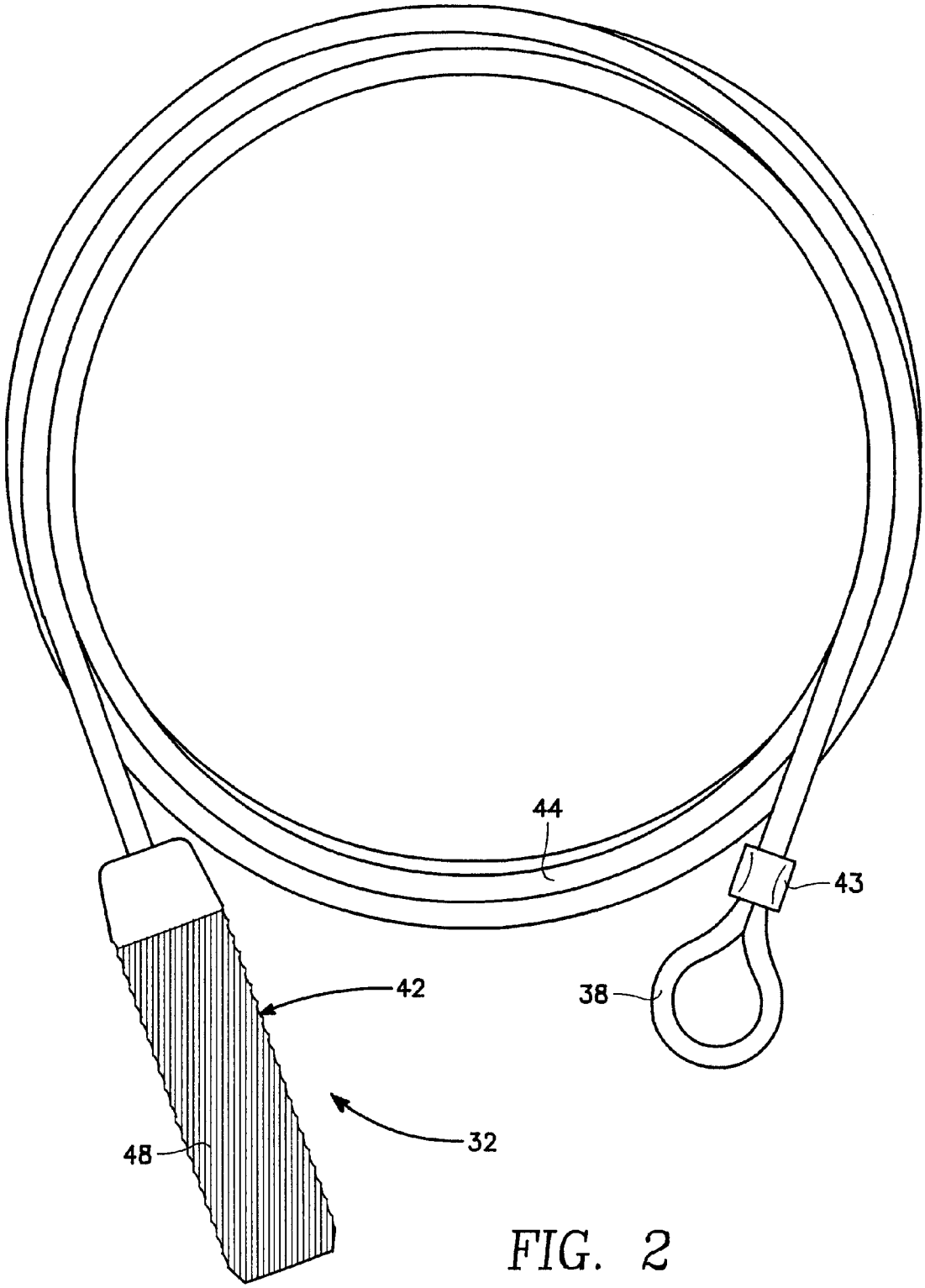
FIG. 2 is a detailed schematic diagram of the well pipe extraction apparatus of FIG. 1.

Referring now to FIGS. 1 and 2, well pipe extraction apparatus 32 comprises soft eye 38 at one end, a cylindrical shaped knurled brass rod 42 at the opposite end and a wire rope 44 which connects the soft eye 38 to the cylindrical shaped knurled brass rod 42. A crimped brass fastener 43 is used to form the soft eye 38. The length of cylindrical shaped knurled brass rod 42 is 5¾ inches. The angle of the taper 46 at the front end of brass rod 42 is approximately 30 degrees.

Well pipe extraction apparatus 32 has a length which is approximately one foot longer than the well depth of well casing 20. Thus, for example, for a well casing 20 having a length of 100 feet the length of the well pipe extraction apparatus 32 would have a length of about 101 feet. The wire rope soft eye 38 then protrudes about one foot above ground level and can be easily attached to the hook 40 for the hoist machinery.

Referring to FIGS. 1, 2 and 3, the outside dimension of the cylindrical shaped knurled brass rod 42 is sized very closely to the inside diameter of the well casing 20 but with sufficient clearance to allow the brass rod 42 to slide easily to the bottom end 36 of the well casing 20 in the manner shown in FIG. 1.

For PVC pipe the nominal name refers to the inner diameter (I.D.) of the pipe. Thus, for example, when a one inch PVC pipe is used to form well casing 20, well casing 20 will have an inside diameter of 1.016 inches. The difference between the outer diameter of brass rod 42 and the inner diameter of well casing 20 is 0.011 inches. The difference between the outer diameter of brass rod 42 and the inner diameter of well casing 20 remains constant for all sizes of PVC pipe used in groundwater monitor well casings. As an illustrative example, for a 1.016 inch ID PVC pipe used as well casing 20, the outside diameter of brass rod 42 is 1.005 inches.

Figure 3A:
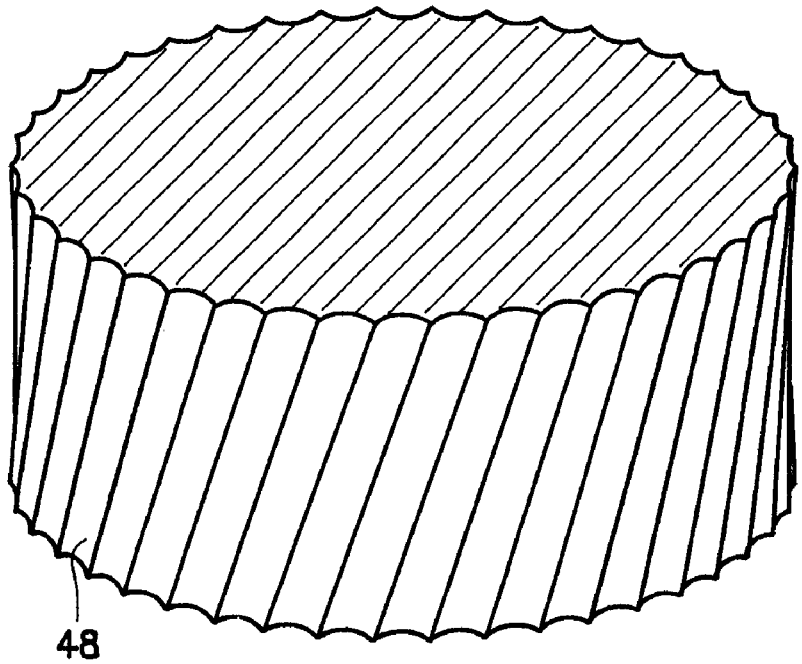
FIGS. 3A and 3B are detailed schematic diagrams of the grooves within the cylindrical shaped knurled brass rod of FIG. 2.
Figure 3B:
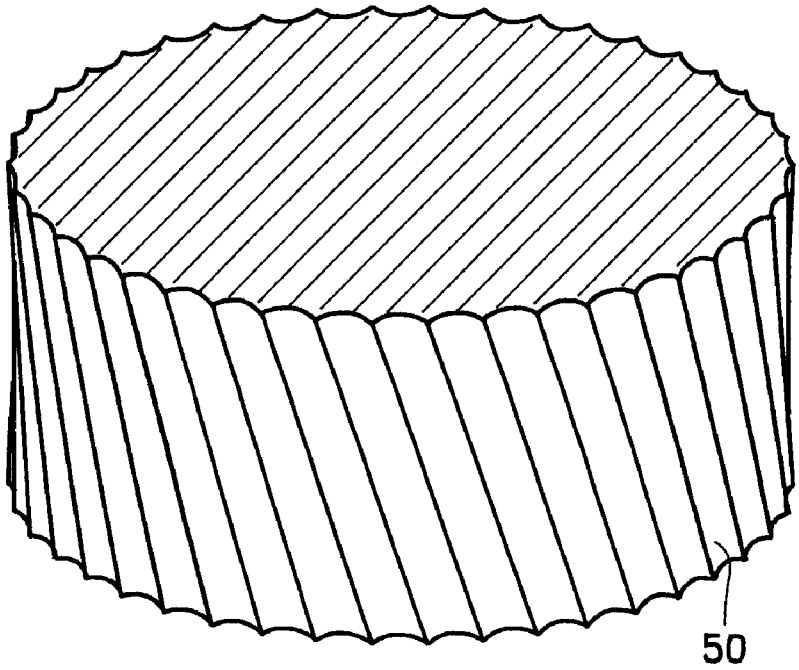

The brass rod 42 has a knurl pattern which comprises a plurality of right hand grooves 48 as shown in FIG. 3A. The right hand grooves 48 extend from the rear end of brass rod 42 to the taper 46 of brass rod 42. Alternatively, the knurl pattern for brass rod 42 may comprise a plurality of left hand grooves 50 as shown in FIG. 3B.

Referring to FIGS. 1, 2 and 3A, the user/operator of well pipe extraction apparatus 32 first lowers brass rod 42 to the bottom 36 of the well casing 20 in the manner illustrated in FIG. 1. The user next pours approximately eight ounces of sand down the groundwater monitoring well casing 20. The user waits approximately 2 minutes for the sand particles/grains 52 to settle around the brass rod 42 which is now at the bottom end 36 of the well casing 20 as shown in FIG. 1. The taper 46 of the knurled brass rod 42 acts as a guide to direct the sand particles 52 toward grooves 48 of the knurled brass rod 42.

The sand particles 52 wedge in-between the grooves 48 of the knurled brass rod 42 and the interior surface 34 of the well casing 20. It is the wedging action of multiple sand grains 52 that generates the necessary force to lock the two surfaces together, the outer surface including grooves 48 of brass rod 42 locks to the interior surface 34 of the well casing 20.

The operator attaches the wire rope soft eye 38 to the hook 40 of the power equipment (e.g., hoist, hydraulic lift, winch, etc.) to remove the well casing 20 from the ground 22. The operator then applies moderate tension to the wire rope 40 to wedge the sand particles 52 between the knurled brass rod 42 and the interior surface 34 of the well casing 20 thereby locking them together. The operator slowly applies a steady upward pull on the wire rope 40 until the well casing 20 starts to move in an upward direction, followed rapid upward movement of wire rope 40 to extract the well casing 20 from the ground 22.

The operator removes sections of the well casing 20 from the casing 20 as the casing 20 is pulled from the ground 22. When the last section of the casing 20 is pulled from the ground 22, tap water is applied to the slotted section 54 at the bottom 34 of the well casing 20 to remove the sand particles 52 and free the knurled brass rod 42 from the well casing 20.

At this time it should be noted that the wire rope tension force required to break the well casing free 20 from the ground 22 is considerably less than the friction force that develops between the brass rod 42 and the well casing 20 thereby allowing the well casing 20 to be removed the ground 22. During extraction of the well casing 20, the tensioned wire rope 40 also functions as a guide for the well casing 20 and prevents buckling of the well casing 20.

From the foregoing, it may readily be seen that the present invention comprises a new, unique and exceedingly useful well pipe extraction apparatus which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A well pipe extraction apparatus for removing a groundwater monitoring well fabricated from PVC pipe from the ground without separating and breaking said PVC pipe, said well pipe extraction apparatus comprising:

a wire rope having a predetermined length;

a soft eye formed at one end of said wire rope, said soft eye being removably coupled to a hook from an external hosting device;

a knurled brass rod attached to the opposite end of said wire rope, said knurled brass rod having a cylindrical shaped body and a taper at an upper end thereof, said knurled brass rod having a plurality of grooves which extend from the lower end of said cylindrical shaped body to the taper of said knurled brass rod;

said knurled brass rod being positioned within said PVC pipe at a bottom end of said PVC pipe, the grooves of said knurled brass rod receiving sand particles pored down said PVC pipe, said sand particles being wedged between the grooves of said knurled brass rod and an interior surface of said PVC pipe, locking the bottom end of said knurled brass rod to said PVC pipe to allow said external hoisting device to remove said PVC pipe from the ground without separating and breaking sad PVC pipe; and said PVC pipe being hoisted from the ground from the bottom end hereof to prevent separation and breakage of said PVC pipe as said PVC pipe is being removed from the ground by said external hoisting device.

2. The well pipe extraction apparatus of claim 1 wherein the predetermined length of said wire rope is approximately one foot longer than the length of the PVC pipe of said groundwater monitoring well.

3. The well pipe extraction apparatus of claim 1 wherein said knurled brass rod has a length of about 5¾ inches.

4. The well pipe extraction apparatus of claim 1 wherein the taper of said knurled brass rod is formed at an angle of approximately thirty degrees.

5. The well pipe extraction apparatus of claim 1 wherein said plurality of grooves comprises a plurality of right hand grooves.

6. The well pipe extraction apparatus of claim 1 wherein said plurality of grooves comprises a plurality of left hand grooves.

7. A well pipe extraction apparatus for removing a groundwater monitoring well fabricated from PVC pipe from the ground without separating and breaking said PVC pipe, said well pipe extraction apparatus comprising:

a wire rope having a predetermined length;

a soft eye formed at one end of said wire rope, said soft eye being removably coupled to a hook from an external hosting device;

a knurled brass rod attached to the opposite end of said wire rope, said knurled brass rod having a cylindrical shaped body and a taper at an upper end thereof, said knurled brass rod having a plurality of grooves which extend from the lower end of said cylindrical shaped body to the taper of said knurled brass rod;

said knurled brass rod being positioned within said PVC pipe at a bottom end of said PVC pipe, wherein a difference between an outer diameter for said knurled brass rod and an inner diameter for said PVC pipe is approximately 0.011 inches;

the grooves of said knurled brass rod receiving sand particles pored down said PVC pipe, said sand particles being wedged between the grooves of said knurled brass rod and an interior surface of said PVC pipe, locking said knurled brass rod to said PVC pipe to allow said external hoisting device to remove said PVC pipe from the ground without separating and breaking said PVC pipe; and said PVC pipe being hoisted from the ground from the bottom end thereof to prevent separation and breakage of said PVC pipe as said PVC pipe is being removed from the ground by said external hoisting device.

8. The well pipe extraction apparatus of claim 7 wherein the predetermined length of said wire rope is approximately one foot longer than the length of the PVC pipe of said groundwater monitoring well.

9. The well pipe extraction apparatus of claim 7 wherein said knurled brass rod has a length of about 5¾ inches.

10. The well pipe extraction apparatus of claim 7 wherein the taper of said knurled brass rod is formed at an angle of approximately thirty degrees.

11. The well pipe extraction apparatus of claim 7 wherein said plurality of grooves comprises a plurality of right hand grooves.

12. The well pipe extraction apparatus of claim 7 wherein said plurality of grooves comprises a plurality of left hand grooves.

13. A method for removing a groundwater monitoring well fabricated from PVC pipe from the ground without separating an breaking said PVC pipe comprising the steps of:

(a) positioning a knurled brass rod attached to one end of a wire rope within said PVC pipe at a bottom end of said PVC pipe;

(b) pouring approximately eight ounces of sand particles in a downward direction within said PVC pipe to the bottom end of said PVC pipe;

(c) waiting a predetermined time period for said sand particles to settle within a plurality of grooves formed around an outer surface of said knurled brass rod after said knurled brass rod is positioned at the bottom end of said PVC pipe;

(d) attaching a soft eye located at the other end of said wire rope to a hook for an external hoisting device;

(e) applying tension to said wire rope to wedge said sand particles between said knurled brass rod and an interior surface of said PVC pipe to lock said knurled brass rod to the bottom end of said PV pipe;

(f) providing a steady pull in an upward direction to said knurled brass rod to remove said PVC pipe from the ground without separating and breaking said PVC pipe as said PVC pipe is pulled in said upward direction by said external hoisting device; and (g) separating sections of said PVC pipe from said wire rope during the removal of said PVC pipe from the ground.

14. The method of claim further comprising the step of supplying water to the bottom end of said PVC pipe through a slot located at the bottom end of said PVC pipe to allow for the removal of said knurled brass rod from a last section of said PVC pipe after said PVC pipe is completely removed from the ground, said sand particles being removed from said PVC pipe by the water supplied through said slot to unlock said knurled brass rod from the bottom end of said PVC pipe.

15. The method of claim 13 wherein said predetermined time period is approximately two minutes.

* * * * *